US005207630A

United States Patent [19]

Decker et al.

[11] Patent Number: 5,207,630

[45] Date of Patent: May 4, 1993

[54] CASE OPENING APPARATUS

[76] Inventors: Dennis Decker; Melvin Salwasser; Leslie Salwasser, all of P.O. Box 548, Reedley, Calif. 93654

[21] Appl. No.: 744,698

[22] Filed: Aug. 13, 1991

[51] Int. Cl.[5] ..... B31B 1/80

[52] U.S. Cl. ..... 493/313; 493/315; 493/317; 493/316

[58] Field of Search ..... 493/313, 315, 316, 317

[56] References Cited

U.S. PATENT DOCUMENTS

| | | | |
|---|---|---|---|
| 4,194,442 | 3/1980 | Martelli | 493/315 |
| 4,537,587 | 8/1985 | Langen | 493/315 |
| 4,871,348 | 10/1989 | Konalla | 493/315 |
| 5,102,385 | 5/1992 | Calvert | 493/316 |

*Primary Examiner*—Bruce M. Kisliuk
*Assistant Examiner*—Eileen P. Morgan
*Attorney, Agent, or Firm*—Mark D. Miller

[57] ABSTRACT

A case opening apparatus that is part of a larger case loading and sealing machine which includes a loading bay for holding container blanks in vertical stacks, a means for removing the uppermost container blank from said stack and transferring it into an overhead rail system, and a case opening apparatus utilizing suction above and below the container blank. The case opening apparatus includes an arm that has dual pivots so that by two separate motions it opens and thereafter erects a container blank for subsequent loading and sealing in preparation for shipment.

4 Claims, 9 Drawing Sheets

CASE OPENING APPARATUS

BACKGROUND OF THE INVENTION

1. Field of the Invention

The present invention relates to case opening and loading devices. In particular, the present invention relates to an improved downward case opening apparatus as part of a larger case opening, loading and sealing machine having a vertical magazine for holding case blanks. Blanks are loaded from the magazine into an overhead conveyor which transfers them to the opening apparatus, said apparatus utilizing vacuum suction, gravity and friction to open large numbers of cases in a short amount of time.

2. Description of the Prior Art

In the art, and in the industry, the terms "case" and "carton" (or "box") define two completely different things. A "case" refers to a generally large corrugated cardboard container into which a pre-determined number of smaller containers (e.g. cartons, bottles or cans) are placed for shipping and/or storage. A "case" of beer generally refers to twenty-four 24 cans or bottles of beer in such a corrugated cardboard container. The inside and outside surfaces of a "case" are smooth, but the typical case has wavy corrugated cardboard between such surfaces.

In contrast, a "carton" or "box" is defined by a generally smaller single-unit cardboard container into which a product (e.g. cereal or detergent) is placed. A "carton" of cereal is likely to be found on a grocery store shelf. A "case" might contain twelve (12) cereal boxes in it for shipping to the grocery store. A "carton" typically consists of one sheet of stiff cardboard, with no corrugation in between.

The present invention relates to the opening of larger "cases". Such cases are typically manufactured from a single piece of corrugated cardboard, or the like, and cut into a predetermined pattern and provided with indented fold lines to facilitate folding into rectangular containers. The manufacturer usually fold the pattern once to make it flat. This brings the opposite edges together so that they may be joined. These flat blanks are shipped in this compact form, and must be opened into a rectangular shape by the user for insertion of products and sealing.

There are numerous devices in the prior art designed to open flattened case blanks for the insertion of products or articles therein. There are also several carton/-box opening devices designed to open cartons for the insertion of particular products therein. The primary differences between case-opening machines and carton-opening machines concern the volume (size) of the blanks to be opened, and the material out of which the blanks are made. Both of these aspects affect the speed at which the opening of blanks takes place. Cases are generally much larger than boxes, and therefore require machines that take up more space and are of more sturdy construction than carton opening machines.

Because of the high volume of container blanks that pass through case-opening machines, it is desirable to have a large magazine to hold the flattened blanks prior to being opened.

One of the most common methods of opening folded container blanks utilizes vacuum suction cups attached to the end of a movable arm in conjunction with a frictional surface. The arm swings up to bring the vacuum suction cup into contact with the lowermost container blank from a magazine. The blank is pulled from the magazine by the suction cup as the arm swings back down, and it is forced against a deflectional surface. This friction puts pressure on one or more corners of the flat blank which causes it to open. The opened blank is thereafter moved onto a conveyor mechanism for insertion of product and sealing. U.S Pat. Nos. 3,298,289, 4,066,009, 4,109,444, 4,197,790, and 4,471,601 utilize this method. Unfortunately, this method of opening blanks suffers from several disadvantages. Most importantly, it is slow because a single cycle requires the blank to be pulled down, opened, and moved completely off the arm before the next cycle can be started. A further disadvantage of this method is the requirement that the magazine of blanks be above the swinging arm, and that said magazine be tilted at an angle corresponding to the upswing of the arm. Tilted magazines are generally difficult to load with container blanks, and usually do not have very large capacity.

Several variations of the swinging vacuum arm and deflection surface method of opening container blanks are disclosed in U.S. Pat. Nos. 2,289,820, 3,293,998, 3,533,333, 3,564,980, 3,613,526, 4,331,435, 4,348,853, 4,531,931, 4,621,485, 4,629,446, and 4,892,513. Most of these patents utilize upper and lower vacuum suction cups in conjunction with a deflectional surface for opening container blanks. U.S. Pat. Nos. 3,613,526 and 4,531,931 utilize three (3) separate arms having suction cups thereon. However, each of these patents suffers from the drawback of slowness because of the lag time between cycles; and most also require tilted or small capacity magazines of blank containers.

SUMMARY OF THE INVENTION

The present invention overcomes the above-described drawbacks by providing a case opening apparatus having a large magazine for vertical stacking of case blanks which loads said blanks onto overhead rails for transfer to a downward case opening mechanism.

A plurality of vertical stacks of container blanks may be placed on a series of conveyor belts provided by the invention. Arms fit under the end stack to uniformly raise and ratchet the blanks upward as they are removed from the stack by suction cups. One by one the uppermost container blank on the end stack is pulled upward by an oscillating suction device mounted on a piston. As each blank is pulled up, the adjacent rails open to receive it, and thereafter close to hold the blank in place. The blank is then moved horizontally across the overhead rails toward the case opening mechanism. Once the blank is clear of the magazine, the adjacent rails open again, and the suction device pulls up the next blank which has been ratcheted to the top. This process repeats until the vertical stack of blanks is depleted, at which time a sensor triggers the conveyor belt to move the next stack into position.

The blanks travel horizontally across the top of the machine to the case opening apparatus. Upon reaching the apparatus, a suction cup mounted above the blank is activated so that it attaches to one of the upper surfaces of the blank. An arm having a plurality of adjustable suction cups thereon rotates in and up from the side nearest the magazine, and attaches to the nearest of the two bottom surfaces of the blank. This nearest surface will eventually become one of the sides of the rectangular container, and the other surface, separated by a fold from the nearest surface, will eventually become the bottom of the container.

Once the suction cups are applied to both surfaces of the blank, the rails holding the blank in place open up to allow the blank to drop down as the arm pulls it down and to the side. The arm has two pivots which allow it to make unique and efficient movements for opening and placing the blank into position. First, the arm rotates around an upper pivot slightly less than 90 degrees from the horizontal to bring the near (side) surface of the blank from its horizontal position on the rails to an almost vertical position. Opposing suction applied by the upper suction cup to a top surface of the blank results in the partial opening of the blank as this rotation takes place. Then, the upper suction cup releases the blank so that the far corner of the blank, made up of the side and bottom surfaces, begins to fall. As it falls it is in contact with a guide bar that holds it partially open.

At this point, the arm rotates downward around a lower pivot slightly less than 30 degrees so that the near (side) of the blank, with suction cups still attached, is now exactly vertical. During this second rotation, the far corner of the blank moves past the end of the guide bar and is pushed into a corner defined by a lower horizontal surface and a movable vertical cleat. The end result is a fully erected container blank in position to move down a conveyor for insertion of material and sealing. The suction cups of the arm are released, and the opened blank begins to move down the conveyor. Because of the double pivot rotation of the arm, and its attachment to a side surface of the blank (as opposed to attachment to the bottom of the blank), the arm may begin moving upward to receive the next blank long before the current blank has moved completely off down the conveyor. As a result, there is a reduced lag time between the opening of blanks which allows larger numbers of blanks to be opened in a given period of time.

It is therefore a primary object of the present invention to provide an apparatus for the rapid opening of large cases that utilizes a suction means attached to a doubly pivoted arm for attachment to the side of a case blank, so as to reduce the lag time between the opening of cases.

It is a further object of the present invention to provide a rapid and relatively simple method of opening and erecting folding cases and transporting them to a conveyor.

It is a further object of the present invention to provide a large capacity vertical magazine for the easy placement of vertical stacks of container blanks to be sent through a case opening apparatus.

It is a further object of the present invention to provide a mechanism that provides a continuous supply of container blanks into a horizontal overhead conveyor system for use in conjunction with a container blank opening apparatus.

DETAILED DESCRIPTION OF THE DRAWINGS

Figure 1:
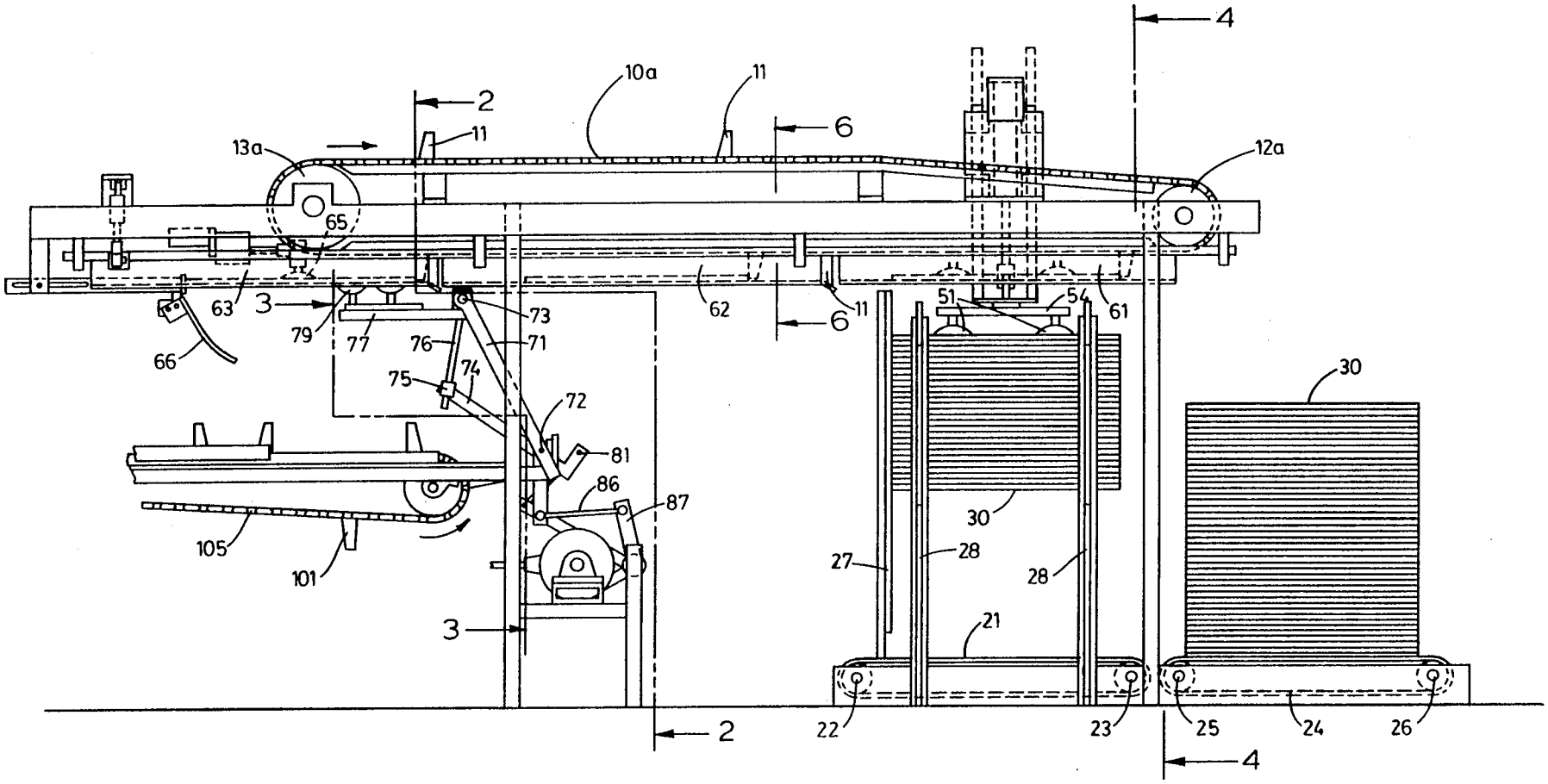
FIG. 1 is a side view of the principal parts of the present invention.

Referring to the drawings wherein like reference characters designate like or corresponding parts throughout the several views, and referring particularly to FIG. 1, it is seen that the invention includes an overhead conveyor comprised of two continuous chains 10*a* and 10*b*, each chain having a series of spaced cleats 11 attached thereto. The chains 10*a* and 10*b* pass around a pair of first sprockets 12*a* and 12*b*, respectively, in the vicinity of the blank magazine and loading bay. Said chains pass around a second pair of second sprockets 13*a* and 13*b* in the vicinity of the opening apparatus (shown in FIG. 3).

Figure 4:
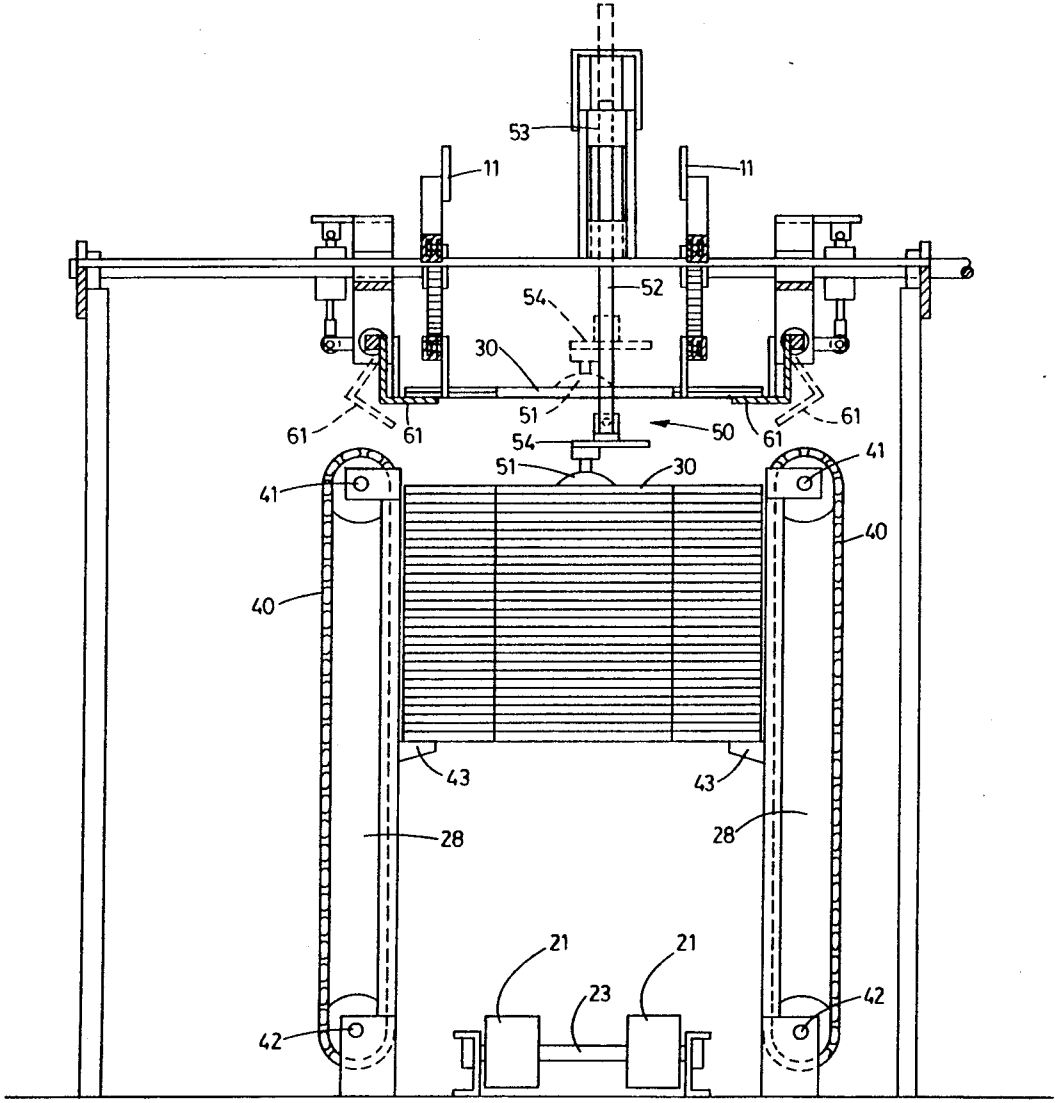
FIG. 4 is an end cutaway view of the blank loading magazine of the present invention along line 4—4 of FIG. 1.

The loading bay, shown in FIGS. 1 and 4, includes a pair of continuous rotatable conveyor belts 21 wrapped snugly around drums 22 and 23 upon which a single stack of container blanks 30 may be placed. Another continuous conveyor belt 24 is also provided which is wrapped around drums 25 and 26. Said second belt 24 is designed to hold a plurality of reserve stacks of container blanks 30, depending upon the length of space between drums 25 and 26. FIG. 1 shows only a single reserve stack, although a larger conveyor assembly would allow for multiple reserve stacks. Drums 23 and 25 are in close proximity to each other so that as belts 21 and 24 are rotated in the same direction, container blanks 30 are transferred from belt 24 to belts 21 for loading.

The stack of blanks 30 slides along belt 21 until the stack makes contact with terminating wall 27. Here a series of four identical vertical assemblies 28 are provided, two on each side of belts 21. Each assembly includes a chain 40 having two cleats 43 thereon, each chain stretched around an upper sprocket 41, and a lower sprocket 42, as seen in FIG. 4. As each chain 40 rotates, cleats 43 come up and under said stack of container blanks 30, raising said stack up and away from belts 21.

A transfer mechanism 50 is provided above the four vertical assemblies 28 for use in removing the topmost blank 30 from the stack and placing it onto a pair of movable horizontal rails 61. Said transfer mechanism consists of a pair of vacuum suction cups 51 attached to a cross member 54, which member is, in turn, attached to a vertical bar 52. Said bar 52 extends downward out of a piston assembly 53 mounted in a central position above the four vertical assemblies 28, and between chains 10*a* and 10*b*.

A pair of movable L-shaped rails 61 are provided immediately below chains 10*a* and 10*b*, said rails 61 being attached to a fulcrum in such a way that they may rotate outward into an open position as shown by the phantom lines in FIG. 4. In the open position, there is sufficient space between said rails 61 for a container blank to pass between them. As the piston 53 pushes bar 52 downward, suction cups 51 are activated. Once cups 51 come into contact with the uppermost container blank 30, piston 53 pulls bar 52 upward lifting said blank 30 from the top of the stack separating from the remaining blanks. When the blank is above rails 61, said rails rotate back to a closed position to hold blank 30 in place horizontally. The suction of cups 51 is then deactivated, and rotating chains 10*a* and 10*b* bring cleats 11 into contact with the blank 30. Cleats push blank 30 horizontally towards the case opening apparatus, along fixed rails 62. Once blank 30 has moved off movable rails 61, the piston and suction cycle restarts to bring up the next blank.

A sensor apparatus is provided to detect the removal of the last blank from the stack above belts 21. When such detection is made, belts 21 and 24 rotate to bring the next stack of blanks 30 into place onto belts 21. At this point chains 40 rotate to bring cleats 43 under the stack to start the loading process over.

Chains 10*a* and 10*b* rotate cleats 11 from the loading assembly toward the case opening apparatus. Blank 30 is pushed by cleats 11 along fixed rails 62 to rotatable rails 63 just above the opening apparatus.

Figure 3:
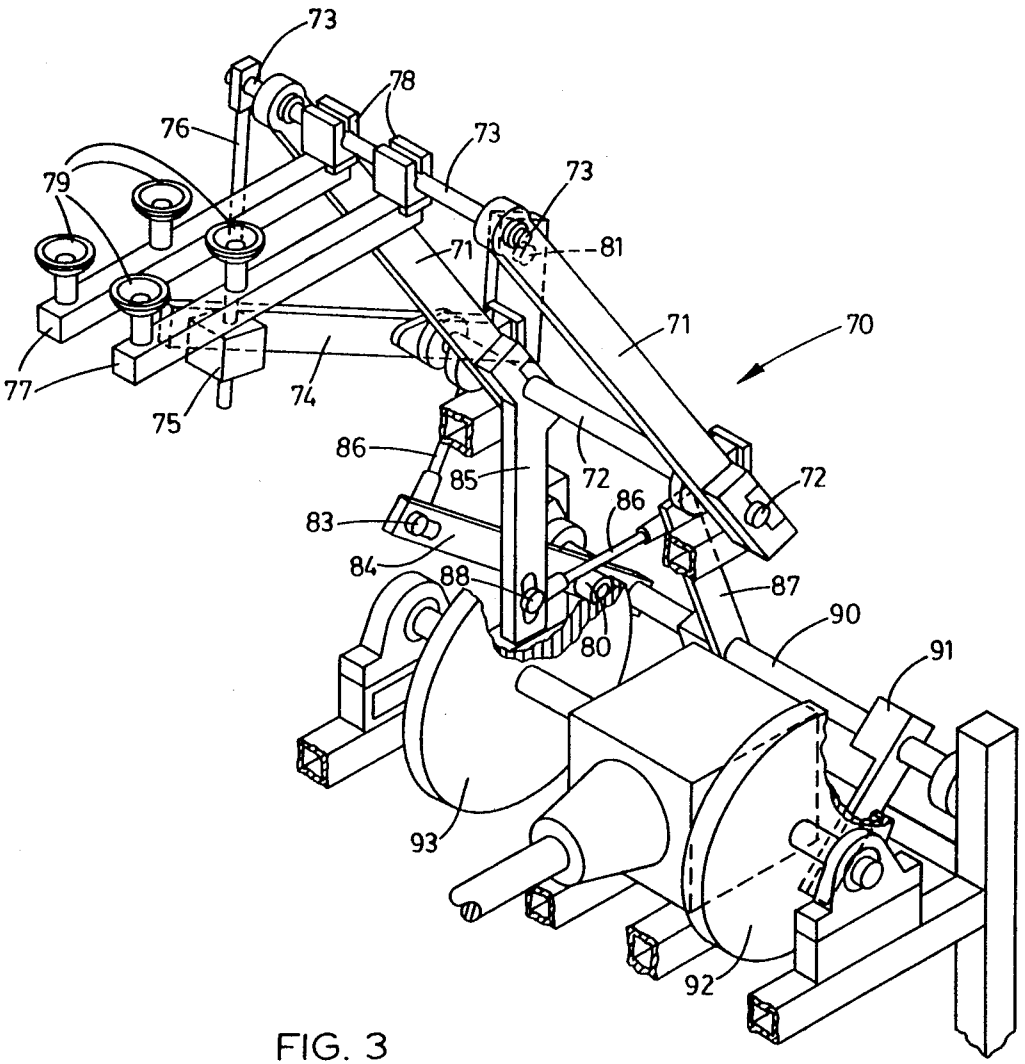
FIG. 3 is a perspective view of only the case opening apparatus of the present invention separated from the rest of the invention.
Figure 5A:
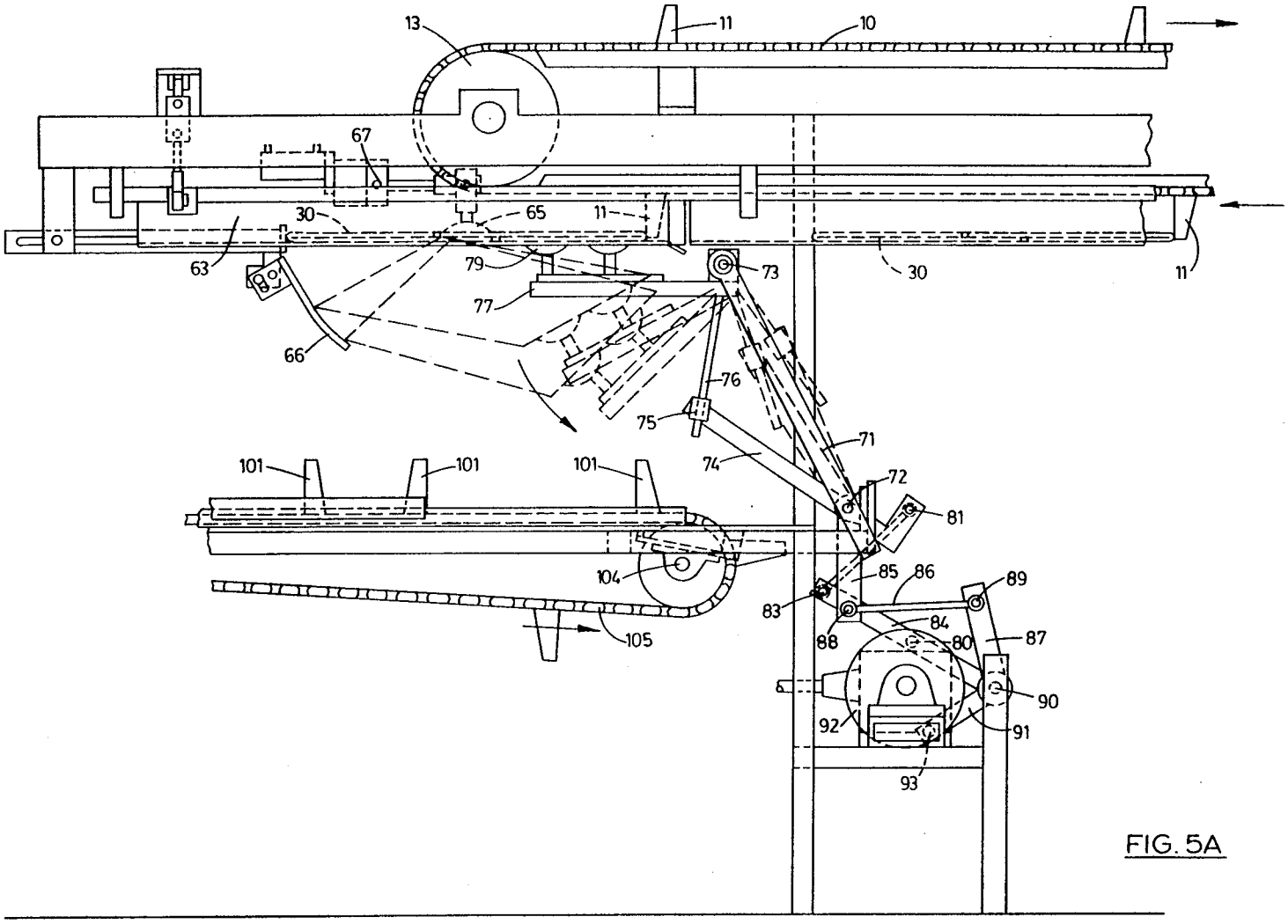
FIG. 5A is a side view of the case opening apparatus of the present invention along line 5—5 of FIG. 2, showing the upper pivot of the opening arm.
Figure 5B:
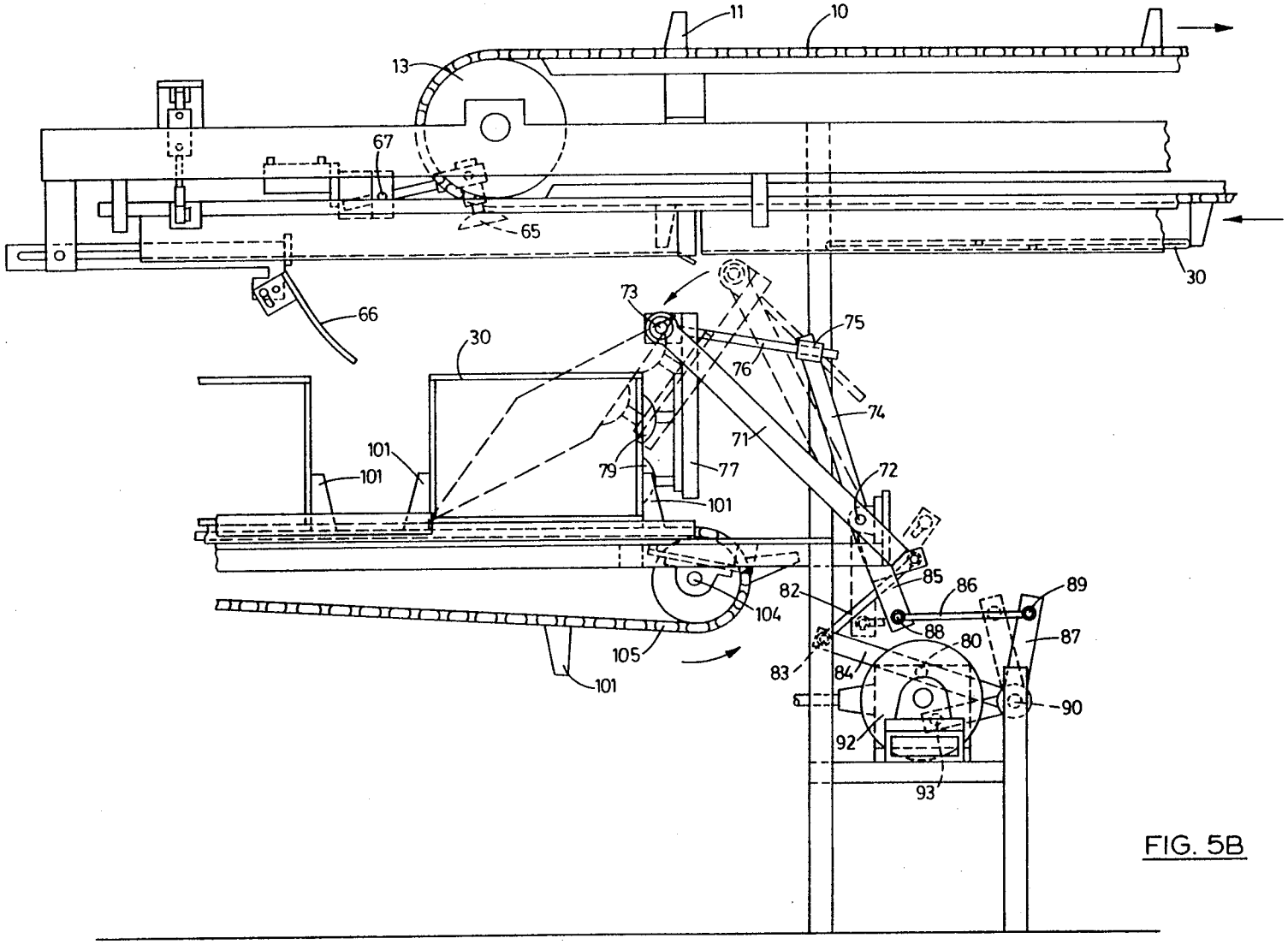
FIG. 5B is a side view of the case opening apparatus of the present invention along line 5—5 of FIG. 2, showing the lower pivot of the opening arm.

The case opening apparatus, generally 70, is shown isolated from the rest of the machine in FIG. 3. Referring to FIGS. 3, 5A and 5B, it can be seen that the apparatus 70 consists of a pair of arms 71, each attached at its lower end to a lower crossbar pivot 72, and at its opposite end to an upper crossbar pivot 73. A separate arm 74 is also attached at its lower end to pivot 72. The opposite end of arm 74 is attached to a joint 75 said joint having a circular bore cut longitudinally therethrough through which bar 76 is slidably placed. The opposite end of bar 76 is attached at upper pivot 73.

A pair of support arms 77 are fixably attached by means 78 to the crossbar of pivot 73. Each of said support arms 77 is provided with a pair of movable suction cups 79.

Arm 74 has an L-shaped region below the point where it attaches to pivot 72. At the end of said L-shaped region another pivot 81 is provided at which point rod 82 is connected. The opposite end of rod 82 is connected at pivot 83 to one end of bar 84. The opposite end of bar 84 is attached to primary rotational shaft 90.

A separate bar 85 is attached at one end to arm 71 at pivot 72. The opposite end of bar 85 is attached to one end of rod 86 at pivot 88. The opposite end of rod 86 is attached to one end of bar 87 at pivot 89. The opposite end of bar 87 is attached to shaft 90.

Primary rotational shaft 90 provides the basic fulcrum from which all movement of the case opening apparatus 70 is derived. Said shaft 90 is attached by bracket 91 and cam-following means to a rotatable cam 92. A guide along the inside of cam 92 is provided along which cam-following means moves. As cam 92 rotates, the guide causes bracket 91 to change position, imparting rotation to shaft 90.

A separate cam 93 is provided with a separate guide to which the central portion of bar 84 is attached by cam following means 80. Similarly, as cam 93 rotates, bar 84 follows the guide of cam 93 and oscillates up and down according to said guide. It should be noted that the opposite end of bar 84 is slidably attached to shaft 90, such that shaft 90 acts only as a pivot, but does not impart rotation to bar 84. The only movement of bar 84 is caused by cam following means 80 following the guide of cam 93.

Two distinct movements are made by the case opening apparatus 70 as it runs through a single cycle. The first movement involves the upswing of arms 77 so that suction cups 79 may attach to the underside of the container blank. It is important to recognize that most of the joints and pivots of the case opening apparatus 70 are adjustable, so that the apparatus may be fine tuned for optimum performance. The apparatus 70 should be adjusted so that the suction cups 79 attach to the side of the container blank as opposed to the bottom as shown in FIG. 5A.

Arm 77 swings up to attach suction cup 79 to a container blank, and then swings back down around pivot 73 to cause said container blank to open as shown in FIG. 5A. Accordingly, the first of the two movements of the case opening apparatus is the arc made by arm 77 around pivot 73. This motion is shown by the phantom lines of FIG. 5A. Once arms 77 have reached their lower most position (as shown by phantom lines in FIG. 5B), the second movement of the case opening apparatus 70 takes place. This second movement is the downward arching motion of arms 71 around pivot 72. The final fully opened position of the container blank is obtained at the end of this second motion as shown in FIG. 5B.

The first movement of the case opening apparatus is accomplished as a result of the motion imparted from cam 93 through pin 80 to bar 84. As bar 84 is pushed up by pin 80, the position of lower pivot 90 of bar 84 remains unchanged, but the position of upper pivot 83 is raised in an upwardly direction. This upward movement is transmitted to rod 82 which is also raised in an upwardly direction. Rod 82 is attached at pivot 81 on the L shaped portion of arm 74. As rod 82 is raised upward, the opposite end of arm 74 (where it is attached to joint 75) is lowered, around pivot 72. The lowering of joint 75 causes it to slide down around rod 76. This motion, in turn, imparts rotation to the upper pivot 73 of bar 76. This rotation is thereafter imparted to arms 77 by way of their attachment 78 to pivot 73. The net result is that as arm 84 is raised by the action of the cam 92, arm 77 is also raised to its highest position as shown in FIG. 5A.

When arms 77 reach their uppermost limit, a vacuum is applied to suction cups 79 so that they attach to the side panel of the container blank 30. Thereafter, the action of cam 92 causes arm 84 to be lowered which imparts the opposite action as that described above, resulting in the lowering of arms 77 around pivot 73.

When the lower most position is reached, as shown in phantom lines in FIG. 5B, the guide of cam 93 continues in a constant position throughout the remainder of its cycle so that no further motion is applied to the assembly attached to arm 84. Thereafter, cam 92 causes cam following means to move so that rotation is imparted by bracket 91 to shaft 90. Arm 87 is also attached to shaft 90, so that as shaft 90 rotates, so does arm 87. This rotation pulls the opposite end of bar 87 outward at pivot point 89 where it attached to rod 86. The opposite end of rod 86 is also pulled out at pivot 88 where it attaches to lower end of arm 85. The pull by rod 86 at the lower end of arm 85 causes the upper end of arm 85 to rotate downward around pivot 72. Arm 85 is attached to pivot 72 which pivot is in turn attached to arms 71. Thus, as the upper end of arm 85 rotates downward, arms 71 rotate downward around pivot 72. This has the result of standing up the container blank as shown by the solid lines of FIG. 5B.

Figure 5C:
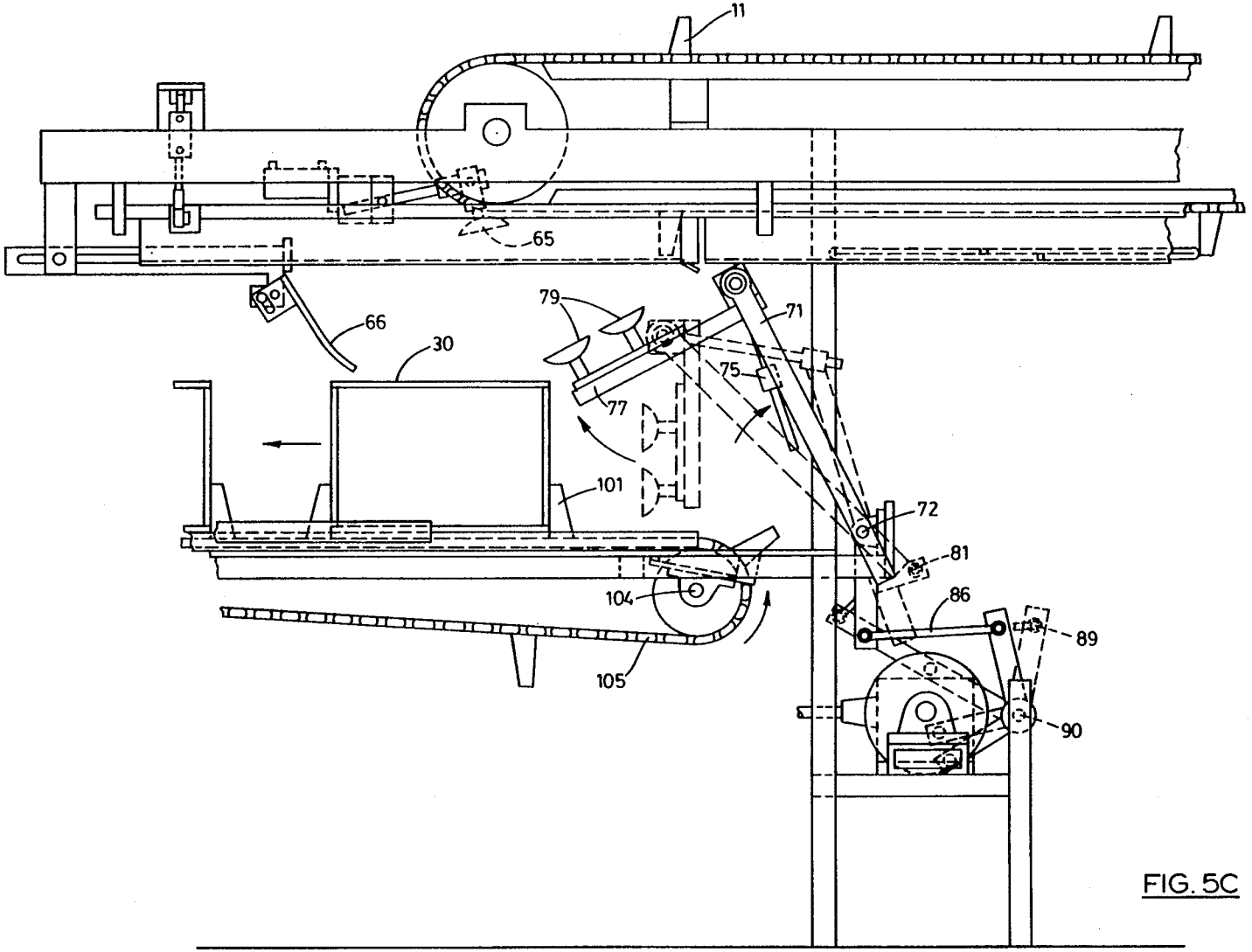
FIG. 5C is a side view of the case opening apparatus of the present invention along line 5—5 of FIG. 2, showing the retraction of the opening arm.
Figure 6:
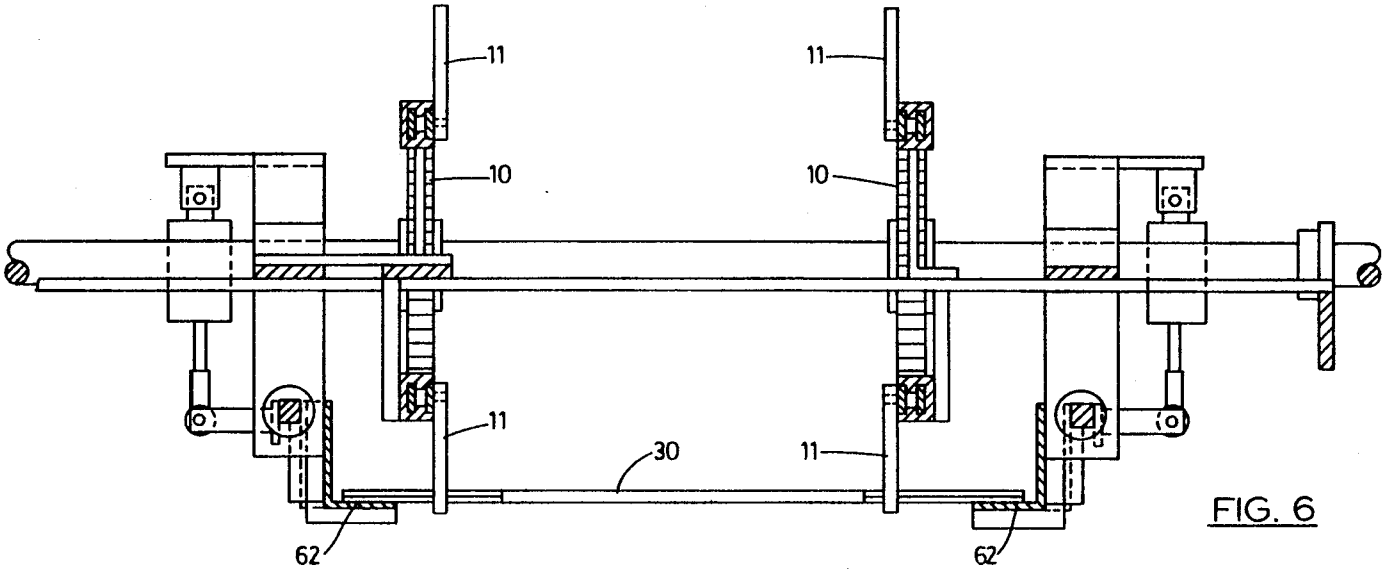
FIG. 6 is an end cutaway view of the present invention along line 6—6 of FIG. 1, showing cross sectional detail of the overheard conveyor.
Figure 7:
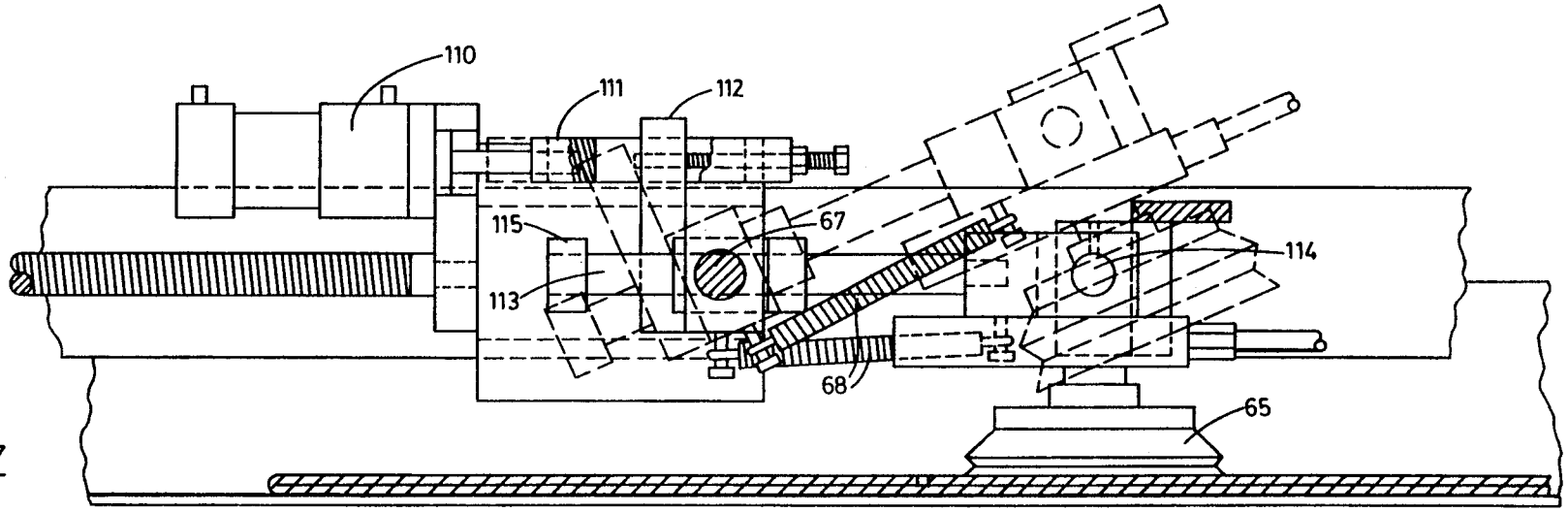
FIG. 7 is a side cutaway view of the present invention along line 7—7 of FIG. 2 showing detail of the upper suction mechanism.
Figure 8:
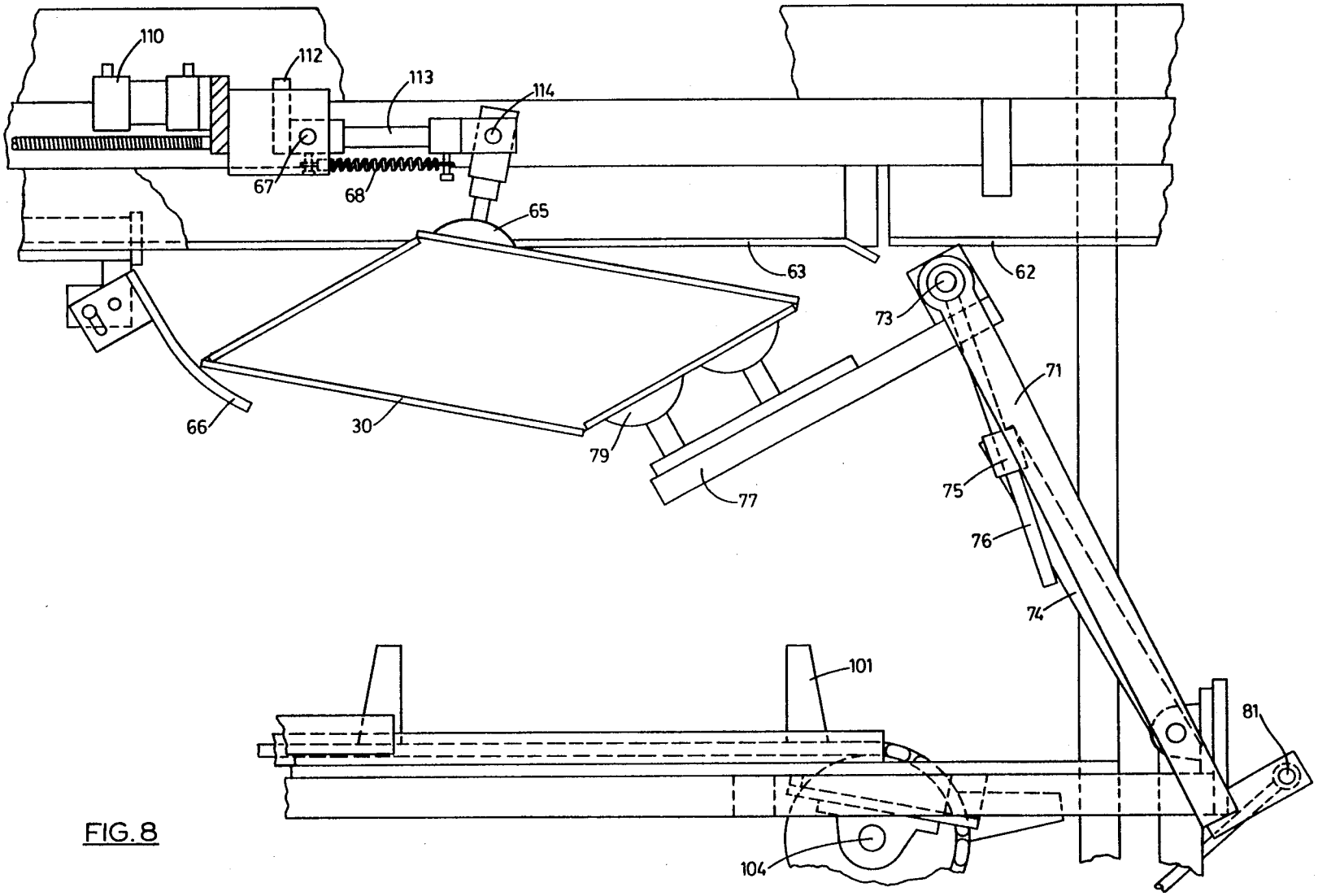
FIG. 8 is a side view of the upper suction mechanism.

As soon as the container blank 30 has been fully erected as shown in FIG. 5B, conveyor 105 begins to move the blank horizontally toward the loading and sealing parts of the machine. At this point, the case opening apparatus 70 performs the reverse of its two distinct movements to move arms 77 and suction cups 79 upward again to engate the next container blank 30 as shown in FIG. 5C. First, arms 71 rotate upward around pivot 72; then arms 77 rotate upward around pivot 73 until suction cups 79 are directly below the next container blank. It should be noted that the upward movement of arms 71 takes place immediately upon the beginning of the horizontal movement of the container blank 30 along conveyor 105. Thus, there is practically no delay in arms 71 and 77 recycling upward to get the next container blank. The opened container blank 30 has scarcely moved by the time arms 71 and 77 have moved back into position to get the next container blank.

During the first downward movement of arms 77, a vacuum applied to upper suction cup 65 causes it to attach to the top of the container blank 30. As arms 77 begin to move downward, the opposing suction from cups 79 underneath the container blank cause the blank to begin to open. Since the first downward motion of arms 77 pulls the blank in both a downward and slightly lateral direction, it is necessary that cup 65 be mounted in such a way it may remain attached to the container blank 30 for a moment during this initial motion to provide the opposing suction which opens up the blank.

This is accomplished by providing an upper suction cup mounting mechanism which includes an L-shaped base piece 112 having a circular bore therethrough into which cross piece 113 is slidably attached. A terminating plug 115 is at one end of cross piece 113, and mounting pivot 114 is located at the opposite end. Spring means 68 holds slidable cross piece 113 in a contractive position within base piece 112. Suction cup 65 is attached by means to pivot 114 of around which it is free to rotate slightly. A piston mechanism 110 is provided which is attached to oscillating bar 111 through which an opening 119 is provided. The upper part of the "L" of base piece 112 is loosably placed through said opening 119, so that as piston 110 moves, base piece 112 is alternately pushed down and up. This oscillating motion moves suction cup 65 down so that it may attach to the upper surface of the container blank 30, and then back up after the blank 30 is released to make way for the next blank.

Once the suction cup 65 has attached itself to the upper portion of the container blank, and the container blank begins to move downward, suction cup 65 rotates slightly around pivot 114, and is extended slightly as bar 113 is pulled so that it may stay briefly attached to the container blank as it is downwardly pulled open.

Figure 2:
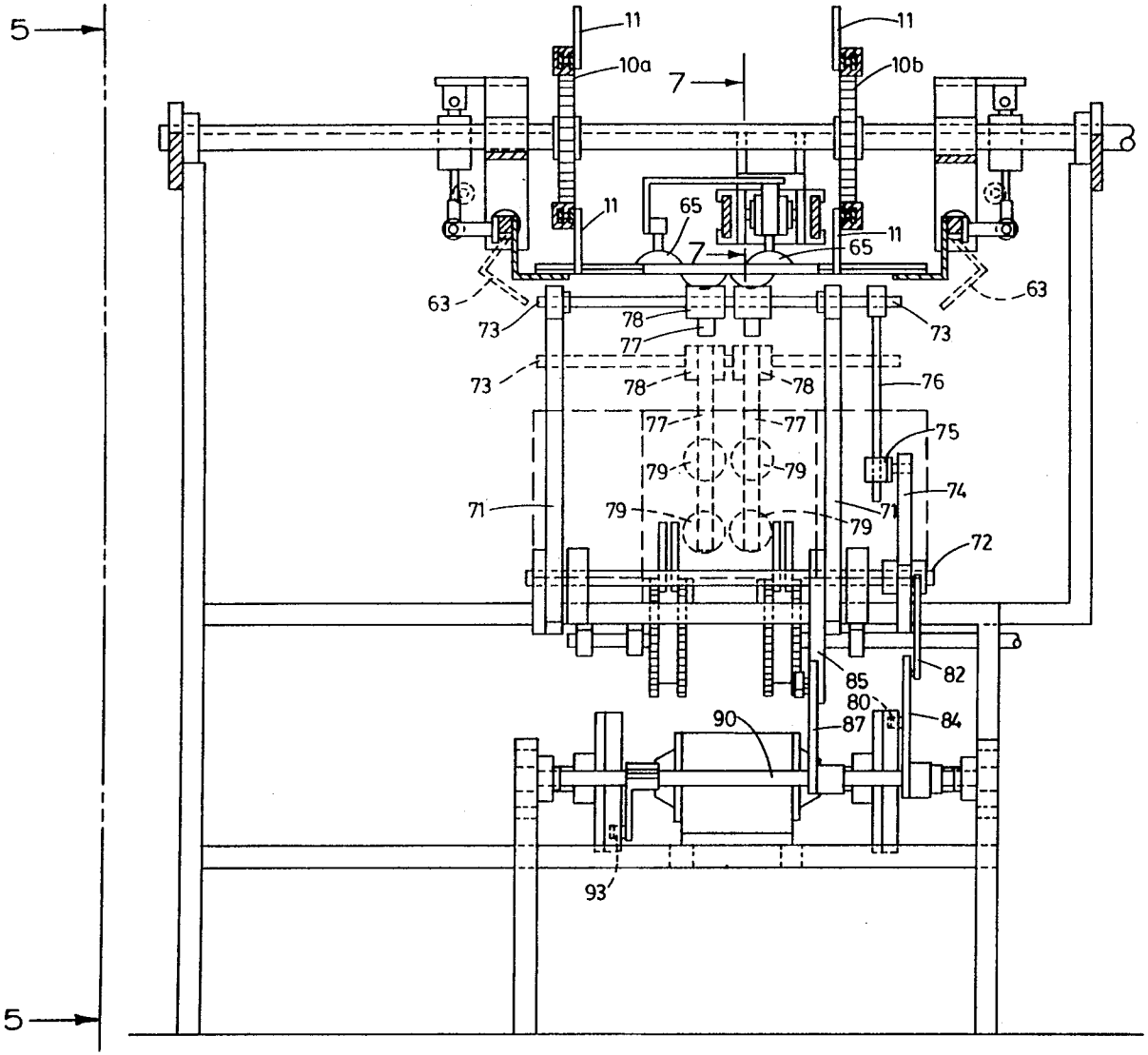
FIG. 2 is an end cutaway view of the case opening apparatus of the present invention along lines 2—2 of FIG. 1.

In operation, a closed container blank is brought up from the loading bay onto rails 61 which close to hold it in place. Cleats 11 then push the closed container blank along rail 62 until it reaches rail 63 just above the case opening apparatus 70. When the blank reaches this point, a piston mechanism causes upper suction cup 65 to rotate downward around pivot 67 so that it comes in contact with the upper surface of the container blank. A vacuum is thereafter applied to suction cup 65 so that it attaches to the upper surface of the blank in place, as rails 63 open outwardly to allow the blank 30 to be brought downward by suction from cups 79 (see FIG. 2) attached to arms 77 as said arms make the first downward motion.

Adjustable guide 66 is provided opposite the opening apparatus 70 to facilitate the proper positioning of the container blank as it is opened. After the opposing suction of cups 65 and 79 pulls the container blank open slightly, the suction on cup 65 is released and said cup 65 moves back up out of the way. One side of the blank is pulled downward by the suction cups 79 attached to moving arms 77. The other side of the blank 30 follows guide 66 (as shown in FIG. 5A), and thereafter falls onto the conveyor (as shown in phantom lines on FIG. 5B). The second motion of the case opening apparatus 70 (i.e., the downward arcing of arms 71) causes the container blank to be fully opened as it is pressed against cleats 101. During the downswing motions of the case opening apparatus 70, upper rails 63 are closed, and the next container blank is moved into position.

Lower conveyor chain 105 has numerous cleats 101 attached thereto for holding the erected container blank in place as it passes through the remainder of the machine for loading and sealing. As soon as the erected container blank begins moving down conveyor 105, arms 71 and 77 begin immediately moving upward to attach to the next container blank. It is not necessary for the erected container blank to be moved completely out of position before arms 71 and 77 are free to move upward again to attach to the next container blank.

DESCRIPTION OF THE PREFERRED EMBODIMENTS

In the preferred embodiment, the present invention is made a part of a larger case packing and sealing machine. The three principle parts of the present invention include the loading bay the overhead transfer assembly, and the case opening apparatus.

In the preferred embodiment, the loading bay is provided with two separate floor mounted conveyors, side by side. A smaller conveyor large enough to hold a single stack of container blanks should be provided immediately below the loading mechanism. A larger conveyor is provided immediately adjacent to the smaller one, upon which a plurality of stacks of closed container blanks may be placed. The larger conveyor should be at approximately floor level so that stacks of container blanks may be easily loaded thereon from pallets by use of a forklift or other means. The easy floor loading of the larger conveyor is a particular advantage of the present invention in that it allows an operator to keep the invention full of container blanks as it is operating. The larger the second conveyor, the fewer times it must be refilled.

Most of the fixed components of the present invention are made of metal. The suction cups should be made of a durable, yet flexible material such as plastic or rubber, and are connected to flexible hoses attached to a vacuum generating means. The conveyors of the loading bay underneath the container blanks may be made of durable material (e.g., steel plate top chain).

The overhead transfer mechanism utilizes a pair of adjustable chains to which cleats made of rigid plastic, acrylic or metal may be attached. The cleats should be durable enough to push the container blanks as they slide between rails 61, 62 and 63. The rails themselves may be made of metal or rigid plastic, and have smooth surfaces.

The suction cups of the opening apparatus should likewise be made of a flexible elastic material such as plastic or rubber with similar hosing. All of the suction cups should be adjustable so that their positions on their respective support structures may be changed to accommodate larger or smaller container blanks. Arms 71, 74, 77, 84, and 87 should have a generally rectangular cross section, with arm 74 having an L-shaped lower region that also has a rectangular cross section. Rods 76, 82, 86 and 90 should have circular cross sections as should pivots 72 and 73. Cams 92 and 93 should be round (as opposed to oval shaped), although either configuration would work depending upon how the guides are placed. All of the joints between the various rods, bars and arms should be slightly movable so that the opening apparatus may be adjusted for optimum performance.

The two cams 92 and 93 should rotate at the same rate, preferably by attachment to the same axle. The axle is in turn attached to a transmission mechanism for connection up to the main power motors of the overall machine.

The chains and cleats of the four vertical loading assemblies should be constructed in the same way as the overhead chains and cleats.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

We claim:

1. A case opening apparatus comprising:

a. a movable overhead suction cup connected to a means for imparting vacuum suction thereto positioned for attachment to the upper surface of a single flattened container blank;

b. a plurality of suction cups adjustably attached to a first pair of pivotally mounted swingable arms and connected to a means for imparting vacuum suction thereto whereby said suction cups may attach to the lower surface of a flattened container blank when said first arms are in their uppermost swingable position;

c. an upper pivot around which said first arms may rotate from an upper horizontal position downward between approximately 30 and 60 degrees to a lower angled position;

d. a second pair of arms attached at one end to said upper pivot and to one end of said first pair of arms, the opposite ends of said second pair of arms defining a second pivot around which said second arms may rotate from an upper nearly-vertical position downward between approximately 30 and 60 degrees to a lower angled position, whereby said first arms are correspondingly brought downward to a vertical position;

e. a means for imparting motion in a continuous cycle that first lowers said first arms from a horizontal position to a downward angle, then lowers said second arms from a nearly vertical position to a different downward angle which has the effect of also lowering said first arms to a vertical position, then reverses direction to raise said second arms which has the effect of also raising said first arms, and then finally raises said first arms back to their original horizontal position at which point the cycle repeats;

whereby a flattened container blank may be fully opened and erected as a result of the suction of said cups and the motion of said arms.

2. The invention described in claim 1 above wherein an adjustable guide piece is provided opposite said first arms for guiding said container blank into position as it is opened.

3. The invention described in claim 2 above wherein said overhead suction cup is movably attached to a pivot which pivot is attached to a slidable member having a spring means to hold it in place, whereby said upper suction cup is able to rotate around said pivot and move laterally in accordance with said slidable member in order to remain attached to the upper surface of said container blank as long as possible while the suction cups on said first arms pull open the lower surface of said container blank.

4. The invention described in claim 3 above wherein said means for imparting motion to said first and second arms comprises a first and second cam means attached by cam-following means to a plurality of rods attached that are, in turn, attached to said first and second arms, each said cam means having a separate guide located thereon, each such guide having a distinct pattern that repeats itself once each cycle in harmony with said other cam means to provide a continuous pattern of motion.

* * * * *